US007884731B2

(12) United States Patent
Mizuo

(10) Patent No.: US 7,884,731 B2
(45) Date of Patent: Feb. 8, 2011

(54) PHOTOELECTRIC SMOKE SENSOR AND LIGHTING EQUIPMENT

(75) Inventor: Kazuhiro Mizuo, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 516 days.

(21) Appl. No.: 12/043,744

(22) Filed: Mar. 6, 2008

(65) Prior Publication Data

US 2008/0218364 A1 Sep. 11, 2008

(30) Foreign Application Priority Data

Mar. 7, 2007 (JP) ..... 2007-057395

(51) Int. Cl.
*G08B 17/00* (2006.01)

(52) U.S. Cl. ..... 340/630; 340/628; 340/693.6; 250/574; 356/438

(58) Field of Classification Search ..... 340/630, 340/628, 693.6; 381/181; 348/135; 250/573, 250/574; 356/438
See application file for complete search history.

(56) References Cited

U.S. PATENT DOCUMENTS

| | | | | |
|---|---|---|---|---|
| 4,758,733 | A * | 7/1988 | Mochizuki | 250/574 |
| 5,400,014 | A * | 3/1995 | Behlke et al. | 340/630 |
| 5,587,790 | A * | 12/1996 | Nagashima | 356/338 |
| 6,396,405 | B1 * | 5/2002 | Bernal et al. | 340/630 |
| 6,737,977 | B2 * | 5/2004 | Nishikawa et al. | 340/628 |
| 6,756,905 | B2 * | 6/2004 | Rattman et al. | 340/630 |
| 6,778,091 | B2 * | 8/2004 | Qualey et al. | 340/628 |
| 6,914,535 | B2 * | 7/2005 | Matsukuma et al. | 340/630 |
| 7,248,173 | B2 | 7/2007 | Yamasaki et al. | |

FOREIGN PATENT DOCUMENTS

| | | | |
|---|---|---|---|
| CN | 2597832 | Y | 1/2004 |
| CN | 1691075 | A | 11/2005 |
| JP | 4-160697 | A | 6/1992 |
| JP | 9-231485 | A | 9/1997 |
| JP | 2000-235000 | A | 8/2000 |
| JP | 2005-309735 | A | 11/2005 |

* cited by examiner

*Primary Examiner*—Davetta W Goins
(74) *Attorney, Agent, or Firm*—Birch, Stewart, Kolasch & Birch, LLP

(57) ABSTRACT

The photoelectric smoke sensor includes a casing member 1 having an internal space S formed by a labyrinth wall 1*b* and an opening 6 communicating with the internal space S on a setting-face side; and a printed board 8 placed on the setting-face side of the casing member 1 and having a hole 8*a* opposed to the opening 6 of the casing member 1. The light emitting element 2 and the light receiving element 4 are mounted on the printed board 8 in such a fashion that the optical axes of the light emitting element 2 and the light receiving element 4 cross each other on one plane that is substantially parallel to an opening plane of the opening 6. The photoelectric smoke sensor can be reduced in both size and cost with a simple construction.

11 Claims, 12 Drawing Sheets

PHOTOELECTRIC SMOKE SENSOR AND LIGHTING EQUIPMENT

CROSS-REFERENCE TO RELATED APPLICATIONS

This nonprovisional application claims priority under 35 U.S.C. §119(a) on Patent Application No(s). 2007-057395 filed in Japan on Mar. 7, 2007, the entire contents of which are hereby incorporated by reference.

BACKGROUND OF THE INVENTION

The present invention relates to a photoelectric smoke sensor and lighting equipment, as well as to a technique for achieving size reduction of the photoelectric smoke sensor and enhancement of its smoke sensibility.

In photoelectric smoke sensors intended for detection of smoke, dust and the like, there have conventionally been employed reflection- or transmission-type sensors or the like using an infrared LED (Light Emitting Diode) and a silicon photodiode. Varieties of contrivance have been incorporated in the placement of those light emitting/receiving elements or the housing internal structure to give thereto effects for removal of disturbance light and removal of stray light.

In one example of conventional photoelectric smoke sensors using a reflection-type sensor, with a view to reducing disturbance light that becomes incident on a light receiving element, a prism lens is used in front of an optical path of a light emitting element and the light receiving element to change the optical path so that the arrangement of the light receiving/emitting elements and the prism lens has a specified angle that prevents light from the light emitting element from going directly into the light receiving element (see, e.g., JP H9-231485 A).

In the housing of this photoelectric smoke sensor, a labyrinth structure is formed by providing therein a disturbance-light shielding pillar for light-trap purpose. This labyrinth structure of the housing is rough-surface processed internally so as to reduce the influences of disturbance light and stray light, thereby reducing characteristic variations due to temperature variations or other environmental variations. However, the optical path change by using a prism lens as described above involves the need for separating the optical path away from a housing bottom portion or cover portion in order to avoid any influences of reflected light inside the housing. This makes an obstacle to thinning of the housing as a problem, incurring limitations on the usage and place of use of the sensor. Besides, use of a larger housing or prism lens would obstruct cost reduction as another effect.

In an optical system in which the optical axis extends slantly upward, such as in conventional photoelectric sensors using diffuse reflected light, the housing, if present forward of the light emitting element, would cause the reflection inside the housing to be larger, necessitating widening the inside of the housing, which leads to a larger size of the sensor itself as a problem. However, without reduction in the internal reflection, disturbance light or internal reflected light other than the diffuse reflected light from smoke would go incident on the light receiving element, with the results of not only deterioration of smoke sensing precision but also vulnerability of the sensor to temperature changes and disturbance light or other surrounding environment changes. Further, use of a prism lens or other like optical parts and size increase of the housing would lead to cost increases.

SUMMARY OF THE INVENTION

Accordingly, an object of the present invention is to provide a photoelectric smoke sensor, as well as lighting equipment using the same, which is capable of reducing both size and cost with a simple construction.

In order to achieve the above object, there is provided a photoelectric smoke sensor for detecting smoke in a region, as well as its vicinities, where an optical axis of a light emitting element and a light-reception axis of a light receiving element cross each other, the photoelectric smoke sensor comprising:

a casing member in which an internal space is formed by a labyrinth wall and in which an opening communicating with the internal space is provided on a setting-face side; and a printed board which is placed on the setting-face side having the opening of the casing member provided thereon and which has a hole opposed to the opening of the casing member, wherein the light emitting element and the light receiving element are mounted on the printed board in such a fashion that the optical axis of the light emitting element and the light-reception axis of the light receiving element cross each other at a point nearby the opening or within the opening in the internal space of the casing member and on one plane that is substantially parallel to an opening plane of the opening.

The light emitting element and the light receiving element may be provided each one or some plurality in number.

In this photoelectric smoke sensor, for example, in an optical system in which a light emitting element given by using an LED (Light Emitting Diode) and a light receiving element given by using a photodiode or phototransistor or the like are mounted on a printed board, where an optical axis of the light emitting element and a light-reception axis of the light receiving element cross each other at a point nearby the opening (or within the opening) in the internal space of the casing member and on one plane that is substantially parallel to an opening plane of the opening, the internal space of the casing member adjoins a setting-face side external space via a region where fore optical axes of the light emitting element and the light receiving element cross each other and the hole of the printed board and the opening of the casing member opposed to vicinities of the region. Since this external space is a space inside the wall or behind the ceiling where the photoelectric smoke sensor is to be set, disturbance light never enters into the casing member, and moreover scattered light going out of the casing member via the opening is diffused into the wide-spread space, so that stray light is disposed of. In this way, reflected light by the casing member or the printed board is eliminated, by which incident light on the light receiving element except reflected light by smoke is reduced. As a result, it becomes achievable to reduce the thickness of the casing member without adopting such a structure as would be involved in prior arts that the housing is increased in height to reduce the intensity of reflected light. Thus, the photoelectric smoke sensor can be reduced in both size and cost with a simple construction.

In one embodiment of the invention, a sloped surface forming an obtuse angle to the plane of the opening containing the optical axis of the light emitting element and the light-reception axis of the light receiving element is provided forward of the light emitting element in its optical axis direction and on an inner wall of the opening of the casing member.

In this embodiment, a sloped surface forming an obtuse angle to the opening plane containing the optical axis of the light emitting element and the light-reception axis of the light receiving element is provided on the inner wall of the opening of the casing member and forward in the optical axis direction of a light beam emitted from the light emitting element, so that light applied to the inner wall of the opening of the casing member is reflected by the sloped surface, passing through the opening of the casing member and the hole of the printed board and going out of the casing member toward the setting-face side. As a result, light that does not impinge on smoke can be prevented from being reflected by the inner wall of the opening of the casing member and going incident on the light receiving element.

In one embodiment of the invention, triangular-edged projections and depressions each having a fore end projecting inward of the opening of the casing member are provided forward of the light emitting element in its optical axis direction and on an inner wall of the opening of the casing member.

In this embodiment, since triangular-edged projections and depressions each having a fore end projecting inward of the opening of the casing member are provided on the inner wall of the opening of the casing member, light emitted forward of the light emitting element can be made to be less reflected by the inner wall of the opening of the casing member, so that reflected light inside the casing member can be prevented from going incident on the light receiving element.

In one embodiment of the invention, a plurality of protrusions are provided at inner portions of the casing member facing its internal space.

In this embodiment, since a plurality of protrusions are provided at inner portions of the casing member facing its internal space, illumination light from the light emitting element does not impinge directly on the inner wall of the opening of the casing member but does impinge on the protrusions so as to be diffused so that the light intensity can be weakened. In this case, the angle of diffusion is such that the light is diffused not only upward but also rightward and leftward with respect to the traveling direction of the illumination light, so that the intensity of the illumination light can be reduced with high efficiency.

In one embodiment of the invention, the plurality of protrusions are pyramidal- or conical-shaped.

In this embodiment, since the plurality of protrusions are pyramidal- or conical-shaped, the direction of reflection by the protrusions can be distributed into upward and right-and-left directions. More desirably, the plurality of protrusions each have a pyramidal or conical shape with its fore end rounded.

In one embodiment of the invention, at least part of the light emitting element is placed in a light emitting element-accommodating recess portion provided in the casing member, and triangular-shaped recesses whose width gradually narrows toward a forward direction are provided on a front-face side of the light emitting element near the light emitting element-accommodating recess portion of the casing member and on both sides of the optical axis of the light emitting element.

In this embodiment, since triangular-shaped recesses whose width gradually narrows toward a forward direction are provided on a front-face side of the light emitting element in the light emitting element-accommodating recess portion of the casing member and on both sides of the optical axis of a light beam emitted from the light emitting element, part of light spreading outward of the optical axis of the light beam from the light emitting element is repeatedly reflected by the triangular-shaped recesses so as to be damped. Use of triangular-shaped recesses having such a light trap effect allows both the light trap effect and the size reduction of the optical system to be fulfilled at the same time.

In one embodiment of the invention, the photoelectric smoke sensor further comprises:

a smoke sensing portion for sensing smoke based on a received light quantity detected by the light receiving element; and an alarm display section which has an alarm-display window portion that transmits visible rays and near- and far-infrared rays, and which displays an alarm upon sensing of smoke by the smoke sensing portion.

In this embodiment, when the smoke sensing portion has sensed smoke based on a received light quantity of the light receiving element, an alarm is displayed by the alarm display section, so that a person can be visually notified of an alarm against smoke.

For example, when smoke or dust is sensed by the smoke sensing portion, the LED of the alarm display section lights up, serving as an alarm display. By virtue of the property that this alarm-display window portion of the alarm display section transmits not only visible rays for alarm display but also near- and far-infrared rays, even though a remote-controller use light receiving element using near infrared rays or a pyroelectric sensor capable of sensing the presence or absence of a person by sensing of far infrared rays is included inside the photoelectric smoke sensor, higher multi-functionality of the photoelectric smoke sensor can be achieved with a smaller space without involving preparation of independent window portions for individual uses. Since these functions use different optical wavelength regions from one another, proximate locations between those functions within one window portion do not entail their interferences and those functions can be fulfilled efficiently.

In one embodiment of the invention, the alarm display section has an alarm-display light emitting element which is placed within the window portion and which is switchable in at least two steps of light emission intensity.

In this embodiment, since the alarm display section allows the emission intensity of the light emitting element to be switched in at least two steps, the brightness of the alarm display section upon operation checking or battery level detection can be made less than the brightness of the alarm display section upon detection of smoke. Thus, the power consumption of the photoelectric smoke sensor can be suppressed.

For example, with adoption of a program that allows the LED current to be switched in at least two steps by a light-up signal of the alarm display section outputted from the microcomputer, the photoelectric smoke sensor is provided with a function of changing the brightness of the light emitting section by changing the LED current between the alarm display mode upon sensing of smoke and the operation checking mode.

In one embodiment of the invention, a remote-controller use light receiving element provided in the window portion of the alarm display section.

In this embodiment, with a remote-controller use light receiving element provided inside the window portion of the alarm display section, it becomes implementable to input a signal to the infrared remote-controller use light receiving element through the window portion so that operations for operation checking and alarm stop in the photoelectric smoke sensor can be executed by using a remote controller that issues infrared signals.

In one embodiment of the invention, the photoelectric smoke sensor further comprises:

a smoke sensing portion for sensing smoke based on a received light quantity of the light receiving element;

an alarm sound generator section for generating an alarm sound upon sensing of smoke by the smoke sensing portion; and a pyroelectric sensor placed in the window portion of the alarm display section to perform sensing of a human body, wherein the alarm sound generator section is enabled to change a level of the alarm sound based on the presence or absence of a human body sensed by the pyroelectric sensor.

In this embodiment, the presence or absence of an indoor human body is detected by the pyroelectric sensor placed within the window portion of the alarm display section, and notification to the outside can be made of the presence or absence of any person by changing the alarm sound level of the alarm sound generator section depending on the presence or absence of a human body.

In addition, the notification of the presence or absence of any person to the outside may alternatively be implemented by changing the light emission color, timing or intensity of the alarm display section depending on the presence or absence of a human body. Further, the alarm-display LED, for which visible-region wavelengths are used, the remote-controller use light receiving element, for which near-infrared region wavelengths are used, and the pyroelectric sensor, for which far infrared rays are used, can be placed in proximity to one another without incurring internal interferences among their respective beams of light by virtue of their using wavelength regions different from one another. Thus, the use of one window portion will do, so that smaller size and lower price can be achieved.

In one embodiment of the invention, lighting equipment includes the above photoelectric smoke sensor.

In this lighting equipment, by driving the photoelectric smoke sensor with the same power supply as with the lighting equipment, the need for replacement of batteries is eliminated, thus making the maintenance unnecessary for long time. Further, the photoelectric smoke sensor, which involves fitting of protrusions on the ceiling or wall, is integrated with the lighting equipment, so that deteriorations of indoor visual impressions can be avoided.

As apparent from the above description, according to the photoelectric smoke sensor of the invention, there can be realized a photoelectric smoke sensor that allows size reduction and cost reduction to be achieved with a simple construction.

Also, according to the lighting equipment of the invention, the above-described photoelectric smoke sensor is included therein, and the photoelectric smoke sensor is driven by the power supply for the lighting equipment, so that the need for replacement of batteries is eliminated, making the maintenance unnecessary for long time. Moreover, the photoelectric smoke sensor, which involves fitting of protrusions on the ceiling or wall, is integrated with the lighting equipment, so that deteriorations of indoor visual impressions can be avoided.

BRIEF DESCRIPTION OF THE DRAWINGS

The present invention will become more fully understood from the detailed description given hereinbelow and the accompanying drawings which are given by way of illustration only, and thus are not intended to limit the present invention, and wherein.

DETAILED DESCRIPTION OF THE INVENTION

Hereinbelow, the photoelectric smoke sensor and the lighting equipment of the present invention will be described in detail by way of embodiments thereof illustrated in the accompanying drawings.

First Embodiment

Figure 1:
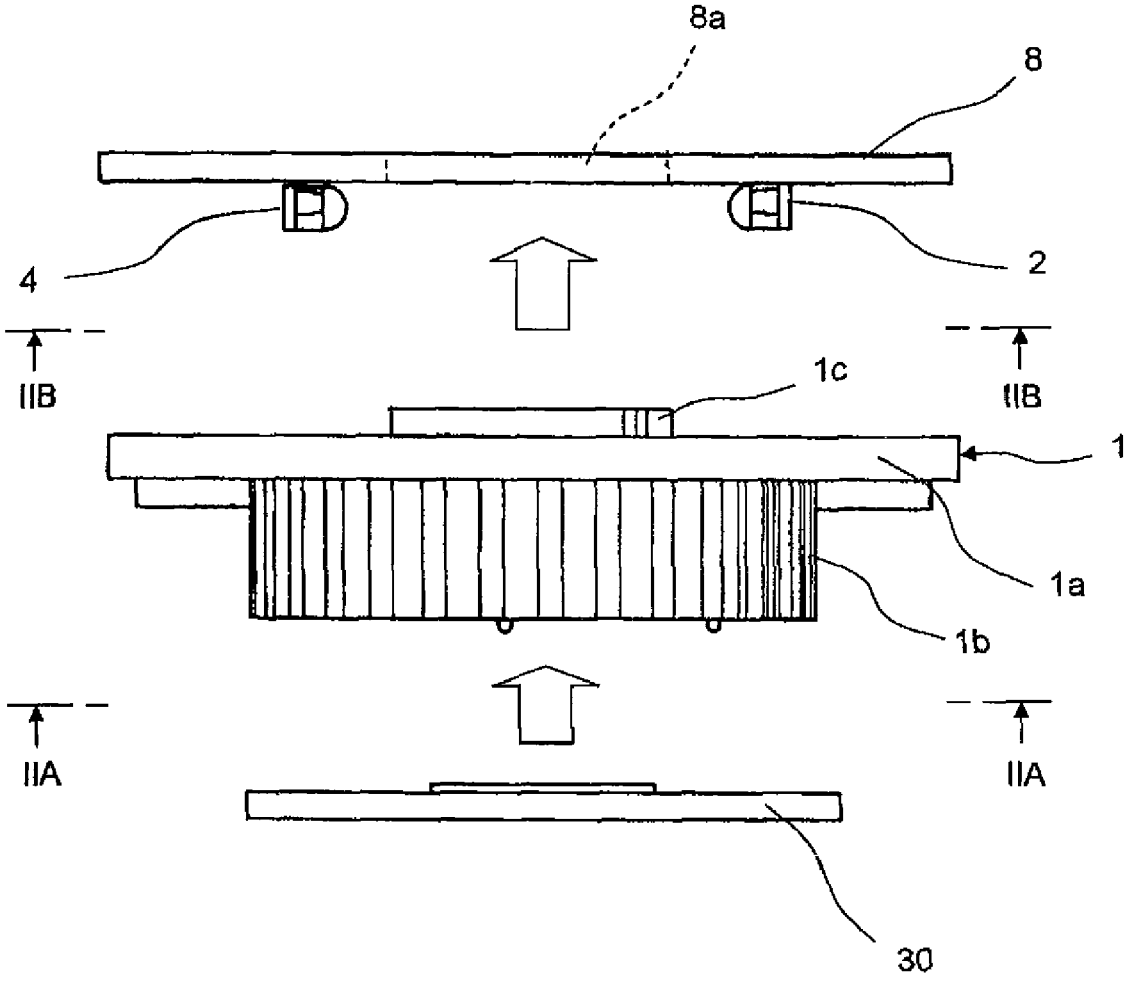
FIG. 1 is an exploded side view of a photoelectric smoke sensor according to a first embodiment of this invention.
Figure 7:
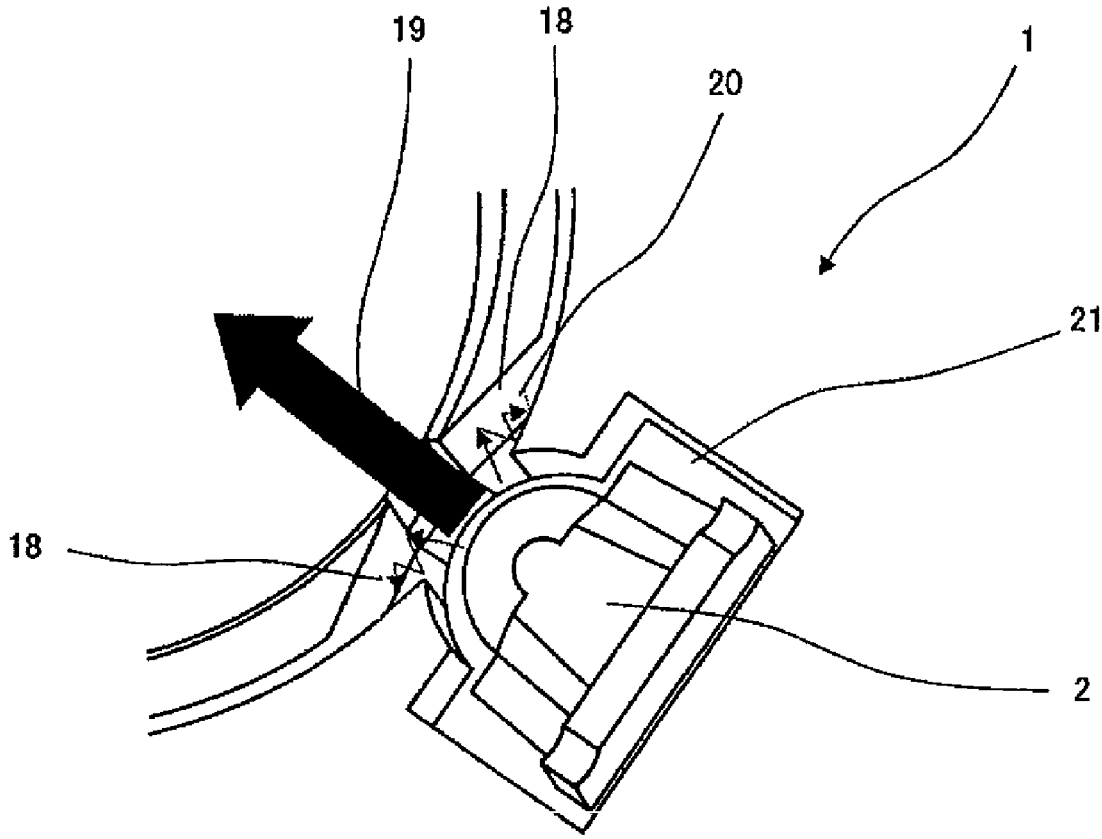
FIG. 7 is an enlarged view of a main part showing an anti-stray light structure.

FIG. 1 shows an exploded side view of a photoelectric smoke sensor according to a first embodiment of the invention. This photoelectric smoke sensor, as shown in FIG. 1, includes: a casing member 1 having a roughly square-shaped base portion 1*a* provided with a circular-shaped opening 6 (shown in FIG. 2A), and a labyrinth wall 1*b* vertically provided on one end face of the base portion 1*a*; a roughly square-shaped printed board 8 which is fitted to the other end face of the casing member 1 and on which a light emitting element 2 and a light receiving element 4 are mounted; and a light-shielding cover 30 that covers a fore end side of the labyrinth wall 1*b*. Also, an annular protruding portion 1*c* is provided so as to protrude from an edge portion of the opening 6 of the casing member 1 toward the printed board 8. This annular protruding portion 1*c* of the casing member 1 is to be inserted into a circular hole 8*a* provided in the printed board 8. The light emitting element 2 and the light receiving element 4 mounted on the printed board 8 are accommodated in a recess portion 21, which is shown in FIG. 7, provided in the casing member 1.

An LED (Light Emitting Diode) is used as the light emitting element 2, and a photodiode or phototransistor is used as the light receiving element 4. As viewed in FIG. 1, one side of the photoelectric smoke sensor on which the printed board 8 is provided is the setting-face side of the photoelectric smoke sensor fixed to a wall, ceiling or the like.

Figure 2A:
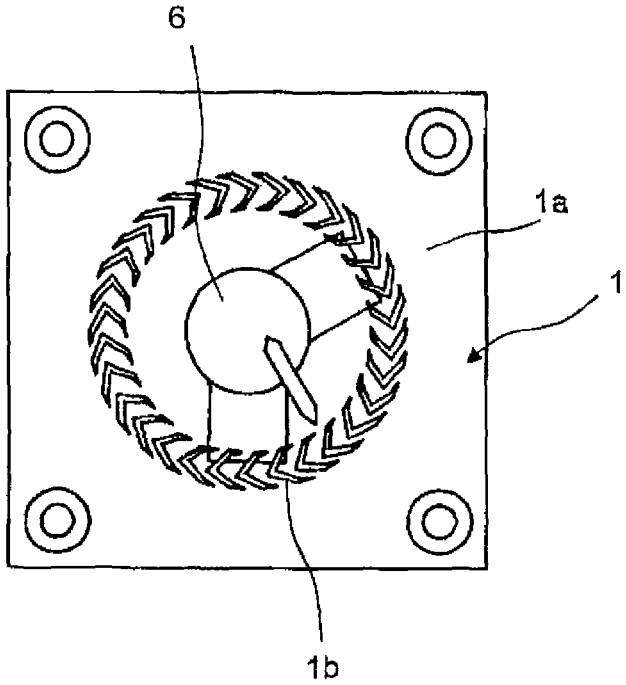
FIG. 2A is a plan view of the casing member as viewed along a line IIA-IIA of FIG. 1.

FIG. 2A shows a plan view of the casing member 1 as viewed along a line IIA-IIA of FIG. 1. On the labyrinth wall 1*b*, a plurality of pillars each having an arrowhead-shaped cross section are arrayed circumferentially to surround the circumference of the opening 6, so that a labyrinth is formed between mutually adjoining pillars.

Figure 2B:
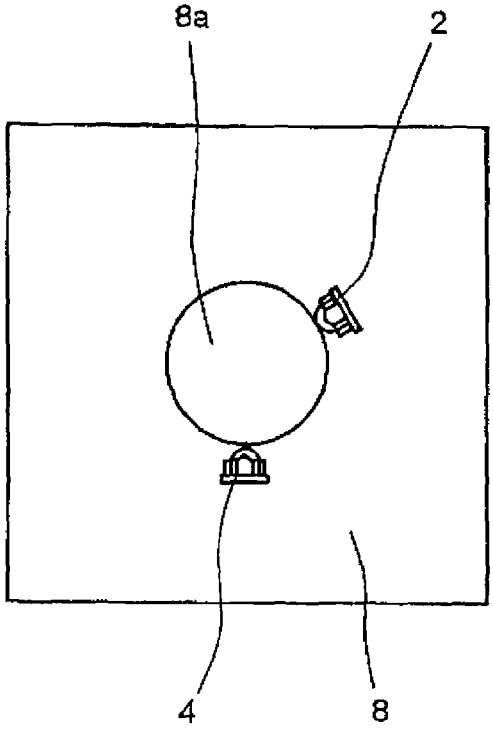
FIG. 2B is a plan view of the printed board as viewed along a line IIB-IIB of FIG. 1.

FIG. 2B shows a plan view of the printed board 8 as viewed along a line IIB-IIB of FIG. 1. As shown in FIG. 2B, the circular hole 8*a* opposed to the opening 6 of the casing member 1 is provided at a roughly center of the printed board 8. In proximity to the circular hole 8*a* of the printed board 8, the light emitting element 2 and the light receiving element 4 are mounted so that an optical axis of the light emitting element 2 and a light-reception axis of the light receiving element 4 become on the same plane as the printed board 8 (on one plane roughly parallel to the opening plane of the opening 6 of the casing member 1) within the opening 6 of the casing member 1. Also mounted on the printed board 8 are chip components, a microcomputer, an IC (Integrated Circuit) and the like.

Figure 3:
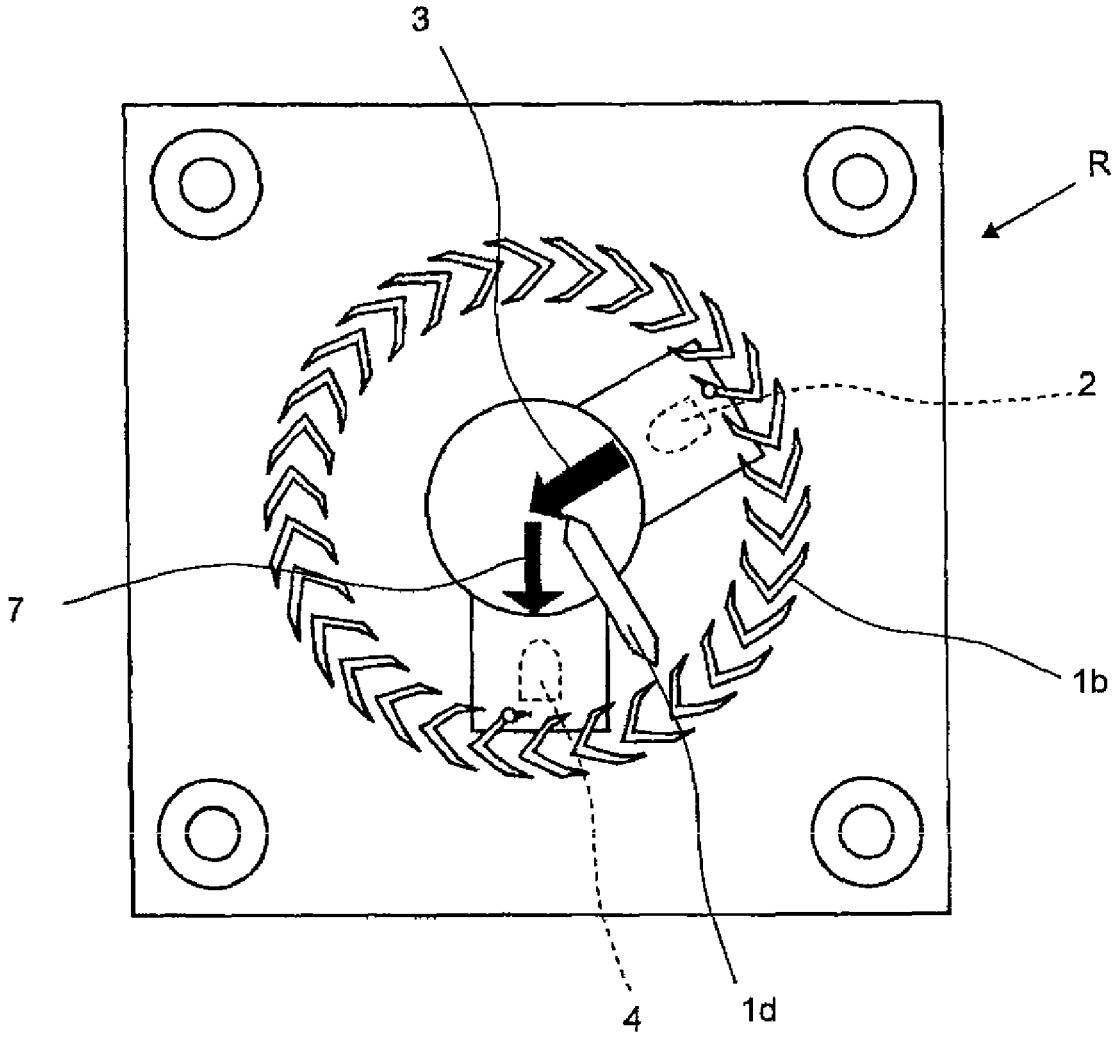
FIG. 3 is an enlarged view of FIG. 2A.

FIG. 3 shows a state in which illumination light 3 derived from the light emitting element 2 impinges on smoke so as to be diffuse-reflected. As shown in FIG. 3, the illumination light 3 from the light emitting element 2 passes through a slit (not shown) of the casing member 1 so as to be applied into the opening 6, and diffuse-reflected light 7 that has impinged on forward smoke passes through a slit (not shown) of the casing member 1 so as to be incident on the light receiving element 4, by which smoke is detected. Inside the labyrinth wall 1*b* of the casing member 1 and between the light emitting element 2 and the light receiving element 4 is vertically provided a light-shielding wall 1*d* which is partly seen in the opening 6. This light-shielding wall 1*d* serves to intercept a linear path between the light emitting element 2 and the light receiving element 4.

Figure 4:
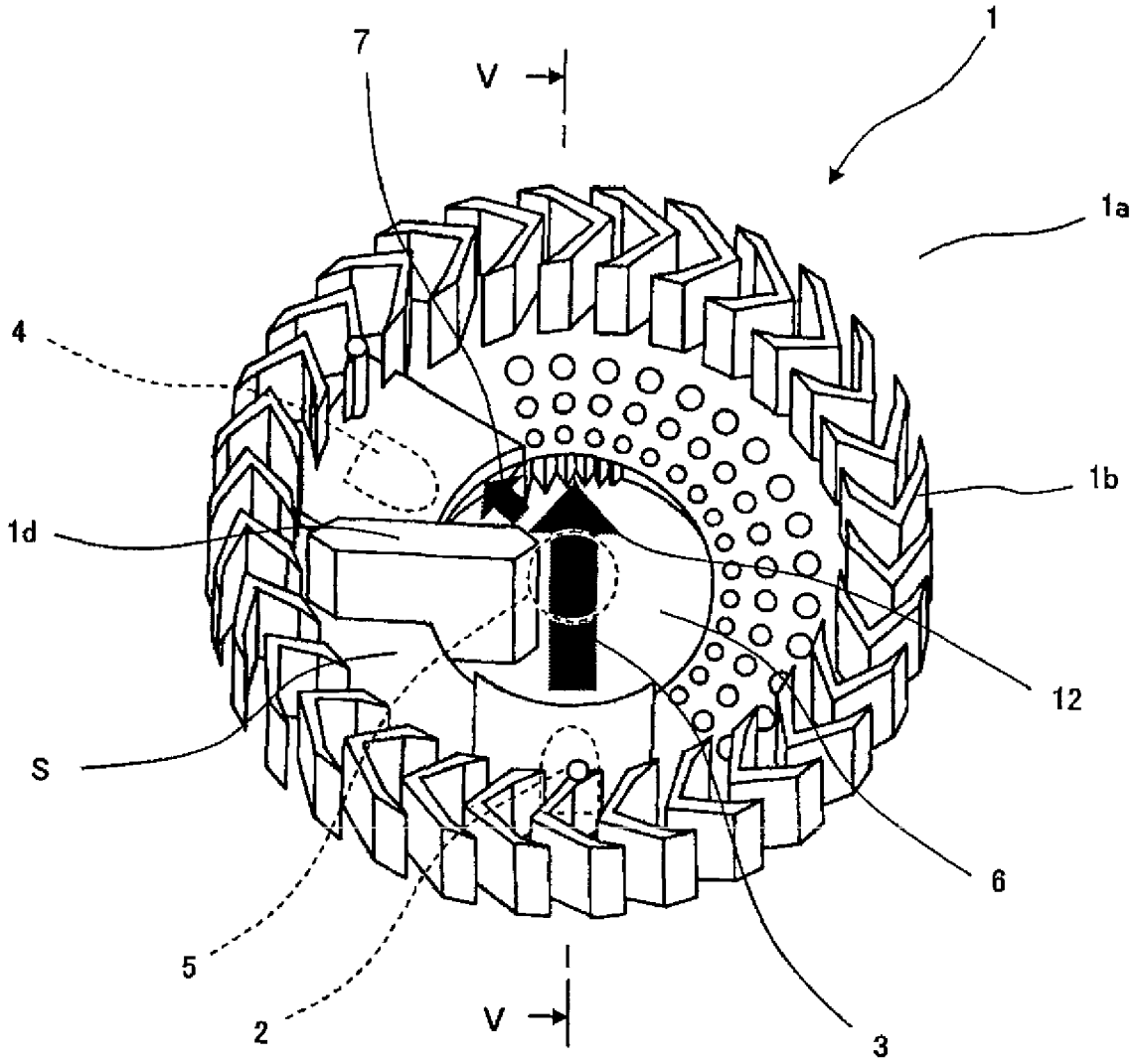
FIG. 4 is a perspective view of a main part of the casing member.
Figure 5:
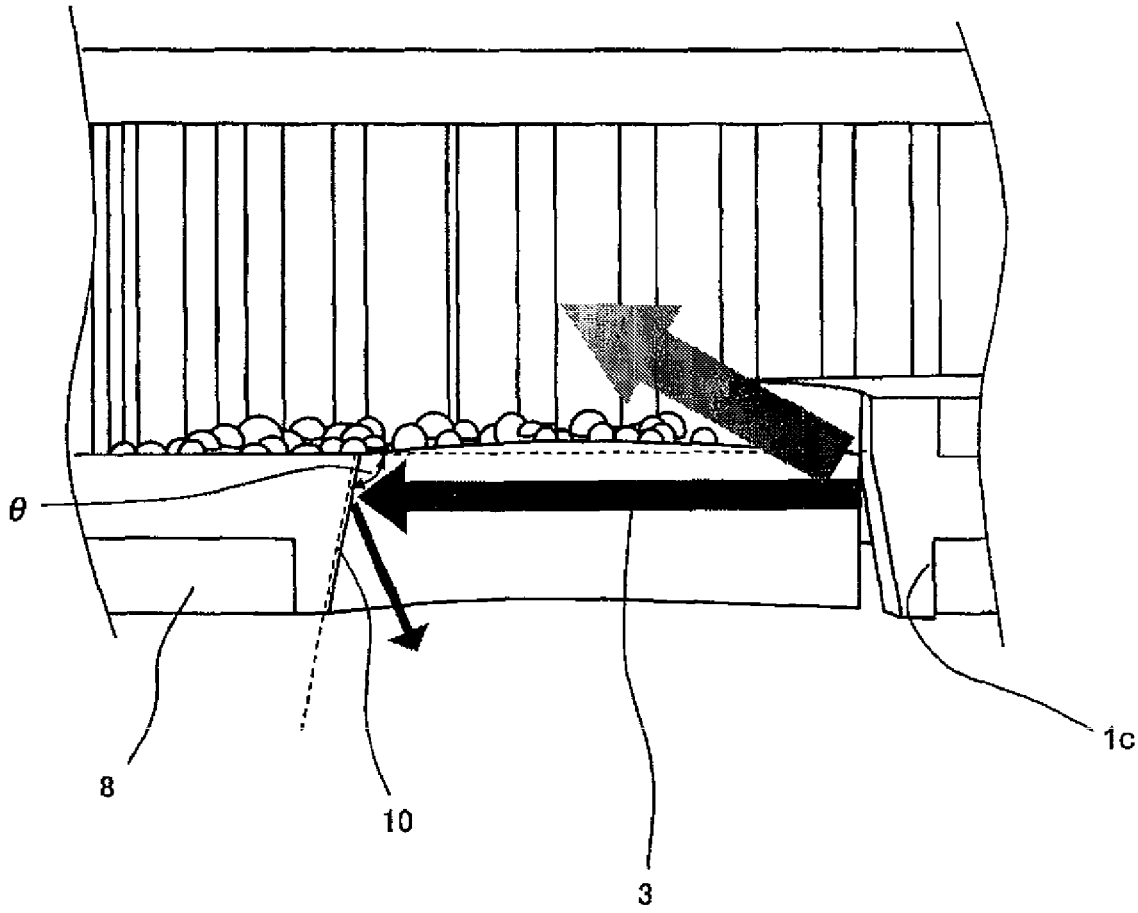
FIG. 5 is a cross-sectional view as viewed along a line V-V of FIG. 4.

FIG. 4 is a perspective view, which is seen along a direction of arrow R shown in FIG. 3 from slantly upward, for explaining the internal structure of the casing member 1 provided with the labyrinth wall 1*b* as well as the principle of detection in the photoelectric smoke sensor. FIG. 5 is a sectional view of around a center of the casing member 1 taken along a line V-V of FIG. 4.

As shown in FIG. 4, illumination light 3 derived from the light emitting element 2 placed inside the casing member 1 is applied to an internal space S forward of the light emitting element 2, and a sensing area 5 where the illumination light 3 and a light-reception field area of the light receiving element 4 cross each other is present in the opening 6 of the casing member 1. When smoke or dust is present in the sensing area 5, diffuse-reflected light 7 resulting from diffuse reflection of the illumination light 3 that has impinged on the smoke or the dust becomes incident on the light receiving element 4, by which the dust or the smoke is detected.

Whereas it has conventionally been practiced that the optical-axis direction is set so as to extend slantly upward from the light emitting element, this invention allows the sensor body to be thinned in thickness by setting the optical axis of the light emitting element 2 and the light-reception axis of the light receiving element 4 on the same plane. For fulfillment of this thickness reduction, even if the optical axes are set on the same plane, stray light 13 due to reflection by the printed board 8 near around the sensing area 5 or the inner wall of the casing member 1 can be reduced by the arrangement that the opening 6 is provided in the casing member 1 of the sensing area 5 located in front of the light emitting element 2 and the light receiving element 4 while the circular hole 8*a* is provided in the printed board 8, on which the light emitting element 2, the light receiving element 4 and electrical components are mounted.

According to this first embodiment, the photoelectric smoke sensor can be reduced in both size (thickness) and cost with a simple construction.

With a space provided around the sensing area 5, illumination light is given from the light emitting element 2 as shown in FIG. 5. In order that light reflected by the casing member 1 or the cross section of the printed board 8 is made less incident on the light receiving element 4, a sloped surface 10 forming an obtuse angle θ to the plane of the opening 6 containing the optical axis of the light emitting element 2 and the light-reception axis of the light receiving element 4 is provided on the inner wall of the opening 6 of the casing member 1 and forward in the optical axis direction of a light beam emitted from the light emitting element 2, so that the reflected light departs from on the plane.

Figure 6:
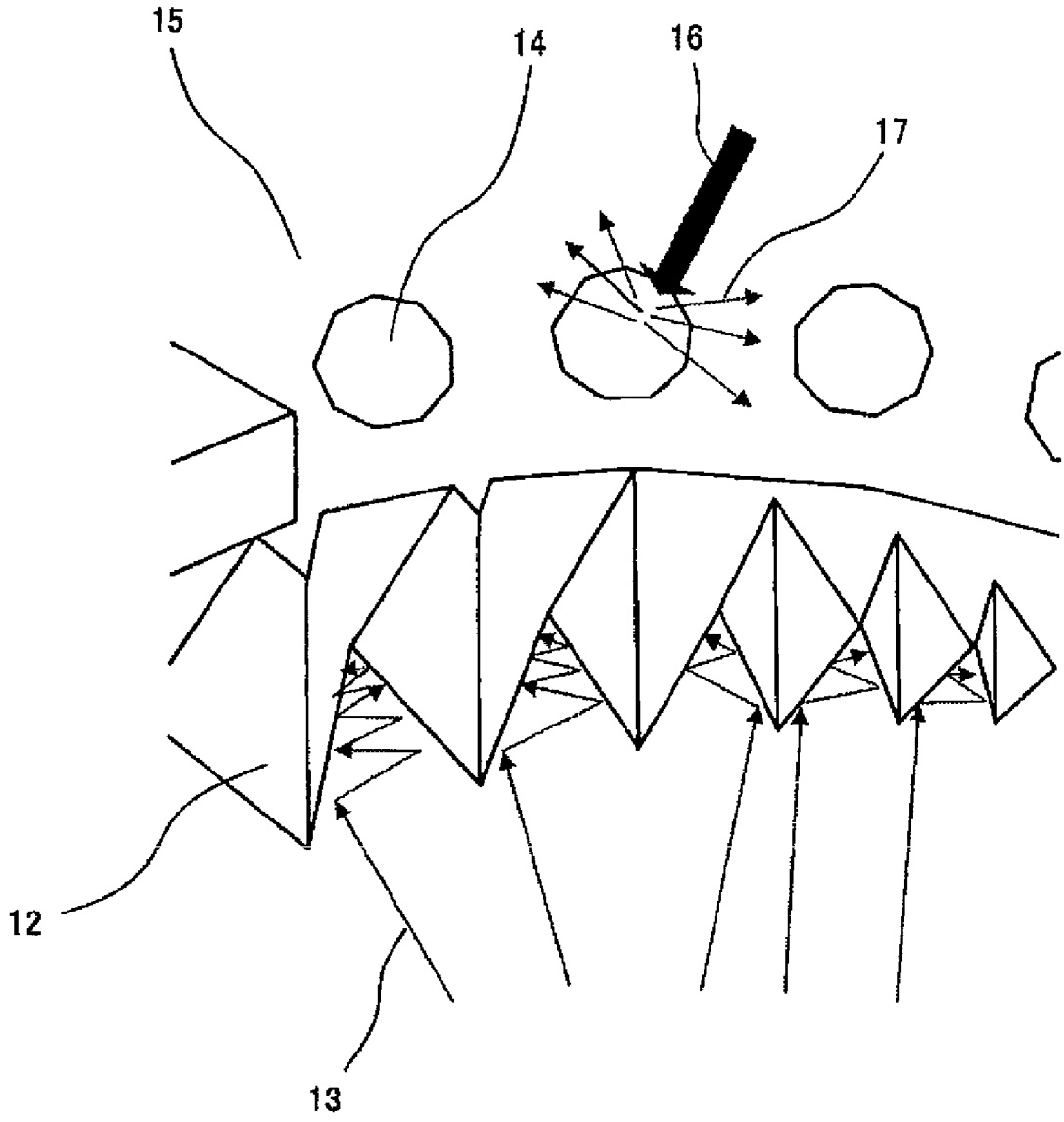
FIG. 6 is an enlarged view showing an anti-stray light structure.

Also, on the inner wall of the casing member 1, on which the illumination light 3 emitted from the light emitting element 2 directly impinges, triangular-edged projections and depressions 12 having their fore ends projecting inward of the opening 6 of the casing member 1 are provided as shown in FIG. 6, so that light having impinged on the inner walls of the triangular-edged projections and depressions 12 is repeatedly reflected so as to be damped. Thus, the stray light 13 due to reflection by the cross section can be reduced.

Further, as an anti-stray light measure, in order to reduce the stray light due to reflection by a bottom face 15 of the casing member 1 and light in the vicinities of the bottom face of the casing member 1 so that light other than the reflected light derived from the smoke is prevented from entering the light receiving element 4, protrusions 14 are provided on the bottom face of the casing member 1 as shown in FIGS. 4 and 6. As a result, light 16 directed toward the bottom face 15 of the casing member 1 impinges on the protrusions 14 and thereby diffused, so that the light can be diffused and damped as shown by diffused light 17 of FIG. 6.

As the protrusions 14 are intended to diffuse light toward various directions, pillar shapes are less effective and forming the protrusions 14 into a pyramidal or conical shape with their fore ends rounded serves the purpose of reducing the stray light effectively.

Further to suppress spreading and stray light of illumination light 3 derived from the light emitting element 2, triangular-shaped recesses 18 are provided in immediate front of the light emitting element 2 on its emission side. As a result of this, light components emitted from the light emitting element 2 that are going toward directions other than the optical axis direction as well as stray light 20 are damped before reaching the sensing area 5, so that light 19 having passed through the triangular-shaped recesses 18 has reduced light components other than parallel light components. Therefore, light unnecessarily reflected inside of the casing member 1 can be reduced, so that incident light on the light receiving element 4 when smoke does not exist can be reduced.

Consequently, since incident light on the light receiving element 4 when smoke does not exist is suppressed by such countermeasures against stray light as shown above, there can be realized a photoelectric smoke sensor capable of performing a stable smoke sensing while keeping its characteristics unchanged even against ambient temperature, disturbance light or other environments.

Figure 8:
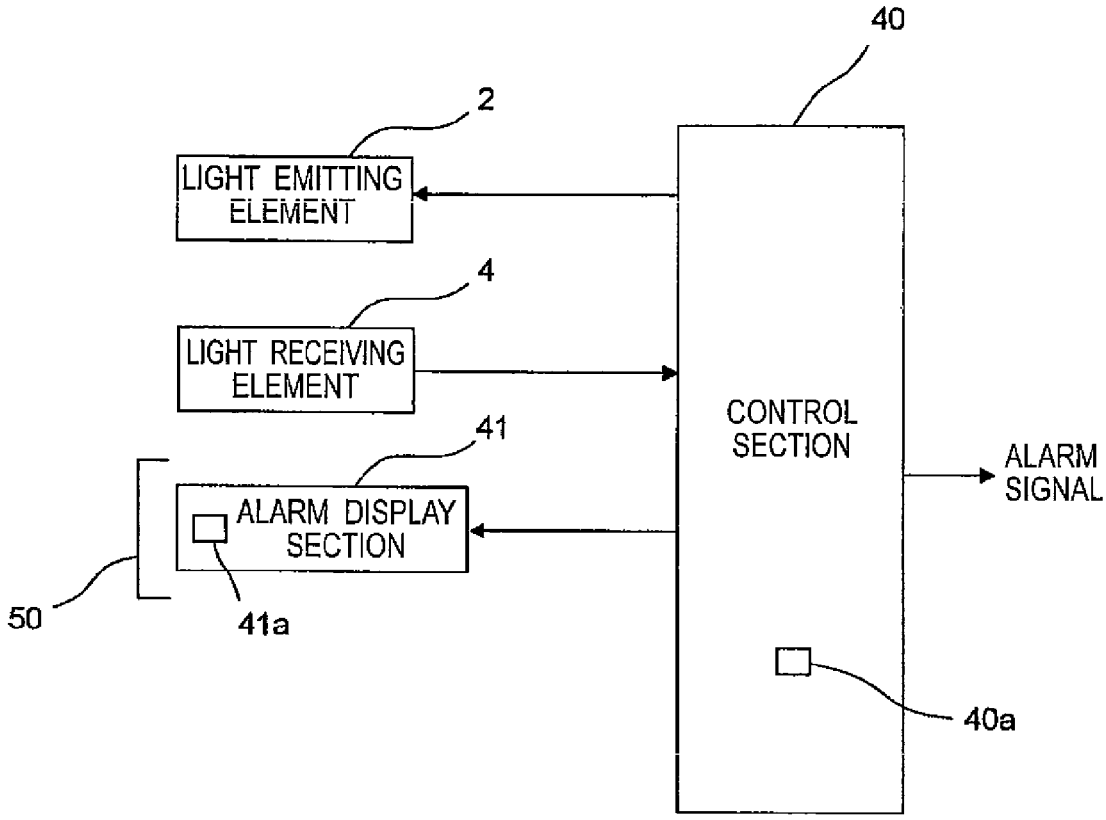
FIG. 8 is a block diagram of the photoelectric smoke sensor.

FIG. 8 shows a block diagram of the photoelectric smoke sensor of the first embodiment. This photoelectric smoke sensor includes a control section 40 for outputting a drive signal to the light emitting element 2, and an alarm display section 41 for displaying a sensing of smoke. The alarm display section 41 has an LED 41*a* and an alarm-display window portion 50 which transmits visible rays emitted from the LED 41*a* (alarm display section 41 and window portion 50 are shown separately in FIG. 8 for convenience).

The control section 40, which is composed of a microcomputer, input/output circuits and the like, has a smoke sensing portion 40*a* for, upon reception of a signal that represents a received light quantity from the light receiving element 4, sensing smoke based on the received light quantity. The control section 40, upon sensing of smoke by the smoke sensing portion 40*a*, outputs an alarm signal to outside.

Further, when the smoke sensing portion 40*a* has sensed smoke based on the received light quantity of the light receiving element, the alarm display section 41 displays an alarm, allowing a person to be visually notified of the alarm to smoke.

Second Embodiment

Figure 9:
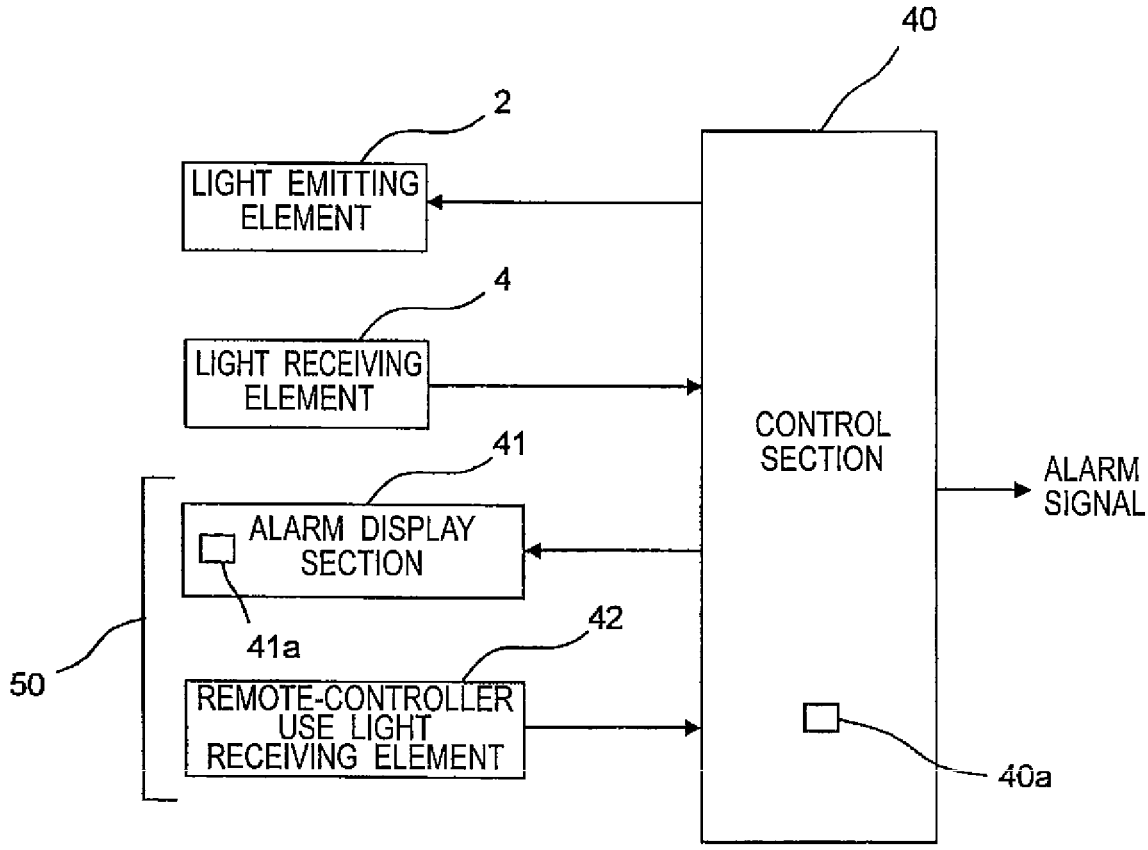
FIG. 9 is a block diagram of a photoelectric smoke sensor which includes a remote-controller use light receiving element according to a second embodiment of this invention.

FIG. 9 shows a block diagram of a photoelectric smoke sensor which includes a remote-controller use light receiving element according to a second embodiment of the invention. This photoelectric smoke sensor of the second embodiment is similar in construction to the photoelectric smoke sensor of the first embodiment shown in FIG. 8, except the remote-controller use light receiving element 42, and so like component members are designated by like reference numerals and their description is omitted.

A material that transmits not only visible rays for alarm display but also near- and far-infrared rays is used for the window portion 50 in the alarm display section 41 of the photoelectric smoke sensor that is provided with countermeasures to stray light as described in the first embodiment so as to be smaller in size and higher in precision. As a result, the LED 41*a* as an example of the alarm-display light emitting element of the alarm display section 41 emits light within the window portion 50, the light being transmitted by the window portion 50 to serve as an alarm display. Moreover, as the remote-controller use light receiving element 42 using near infrared rays is provided within the window portion 50 as well, it becomes implementable, upon reception of a command signal derived from an external remote controller (not shown) by the remote-controller use light receiving element 42, to exercise control for operation checking, alarm stop or the like by the control section 40 based on the command signal.

The photoelectric smoke sensor of this second embodiment has effects similar to those of the photoelectric smoke sensor of the first embodiment.

Also, the photoelectric smoke sensor, which is to be set at an indoor wall-surface upward site or ceiling site, has a need for pressing a switch provided on the photoelectric smoke sensor main body to make an operation checking or an alarm operation stop. For this reason, in the case where the photoelectric smoke sensor is set at a high site, a string linked with the switch of the photoelectric smoke sensor is fitted to allow the operation checking or alarm stop to be made by pulling this string. For this operation, providing the remote-controller use light receiving element 42 in one package at the transparent light emitting section that serves as the window portion 50 including the LED 41*a* of the alarm display section 41 inside thereof makes it possible to perform remote controller operations from the distance. This remote-controller use light receiving element, which performs operations by means of near infrared rays, is free from any influences of light derived from the alarm-display LED 41*a* that emits visible rays.

Third Embodiment

Figure 10:
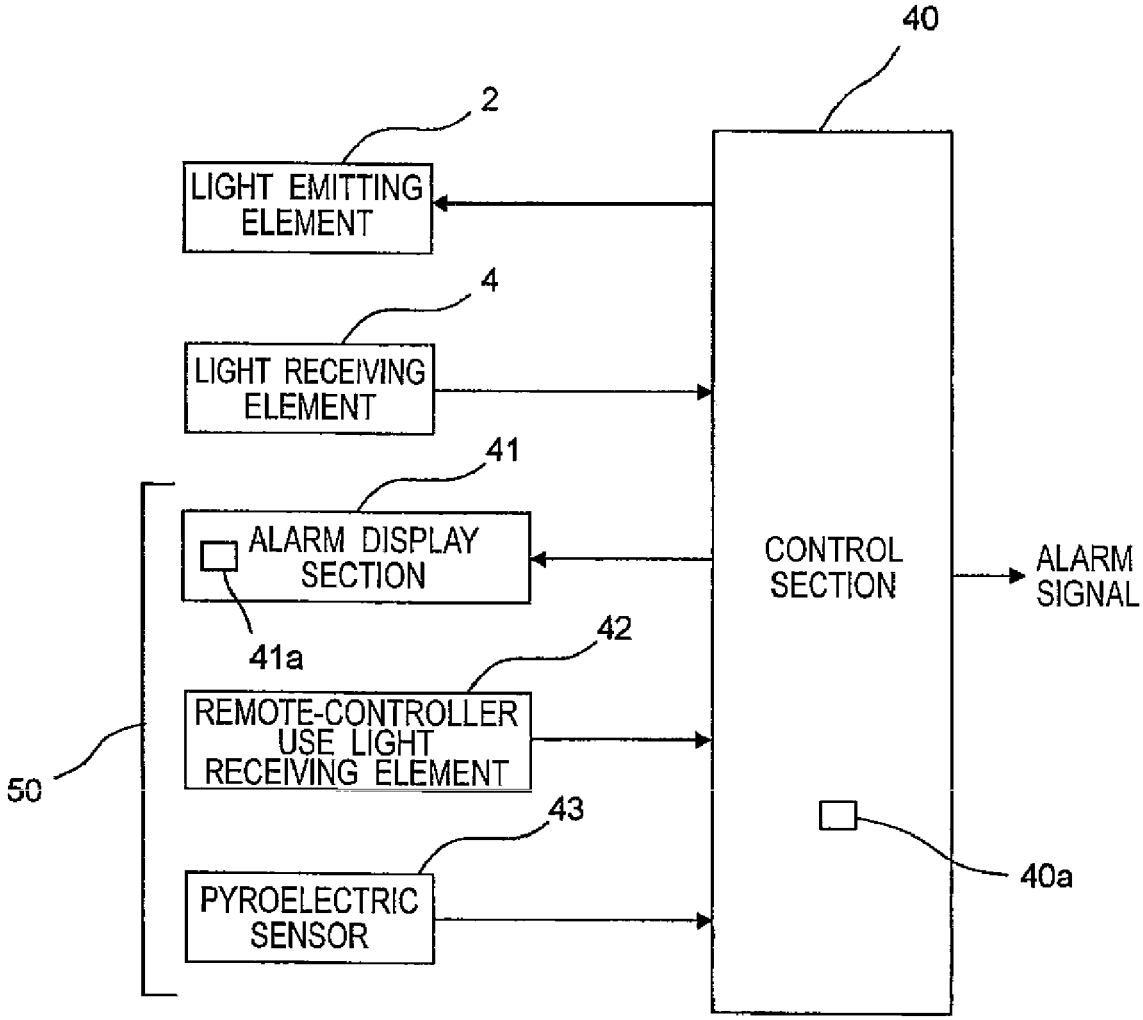
FIG. 10 is a block diagram of a photoelectric smoke sensor which includes a remote-controller use light receiving element and a pyroelectric sensor according to a third embodiment of this invention.

FIG. 10 shows a block diagram of a photoelectric smoke sensor which includes a remote-controller use light receiving element and a pyroelectric sensor according to a third embodiment of the invention. This photoelectric smoke sensor of the third embodiment is similar in construction to the photoelectric smoke sensor of the second embodiment shown in FIG. 9, except the pyroelectric sensor 43, and so like component members are designated by like reference numerals and their description is omitted.

This photoelectric smoke sensor of the third embodiment includes a pyroelectric sensor 43, which senses a human body by sensing far infrared rays, inside the window portion 50 as shown in FIG. 10. In this photoelectric smoke sensor, in which far infrared rays are also transmitted by the window portion 50, the pyroelectric sensor 43 that senses a human body by sensing far infrared rays within the window portion 50 can be provided so as to be contained in the window portion 50.

The photoelectric smoke sensor of this third embodiment has effects similar to those of the photoelectric smoke sensor of the second embodiment.

Further, in the case where a human body is present in a room or passage at which the photoelectric smoke sensor of this invention is set, the human body can be sensed, and notification of the presence of a person can be made to another room or the outside. In this case, visible rays are utilized for the emission wavelength of the LED 41*a* of the alarm display section 41, near infrared rays are utilized for the sensitivity wavelength of the remote-controller use light receiving element 42, and far infrared rays are utilized for the pyroelectric sensor 43. Since their wavelength regions in use are different from one another, there occur no interferences, so that with use of one window portion 50, all the optical elements can be provided inside. Thus, the photoelectric smoke sensor can be made smaller in size and lower in cost.

Fourth Embodiment

Figure 11:
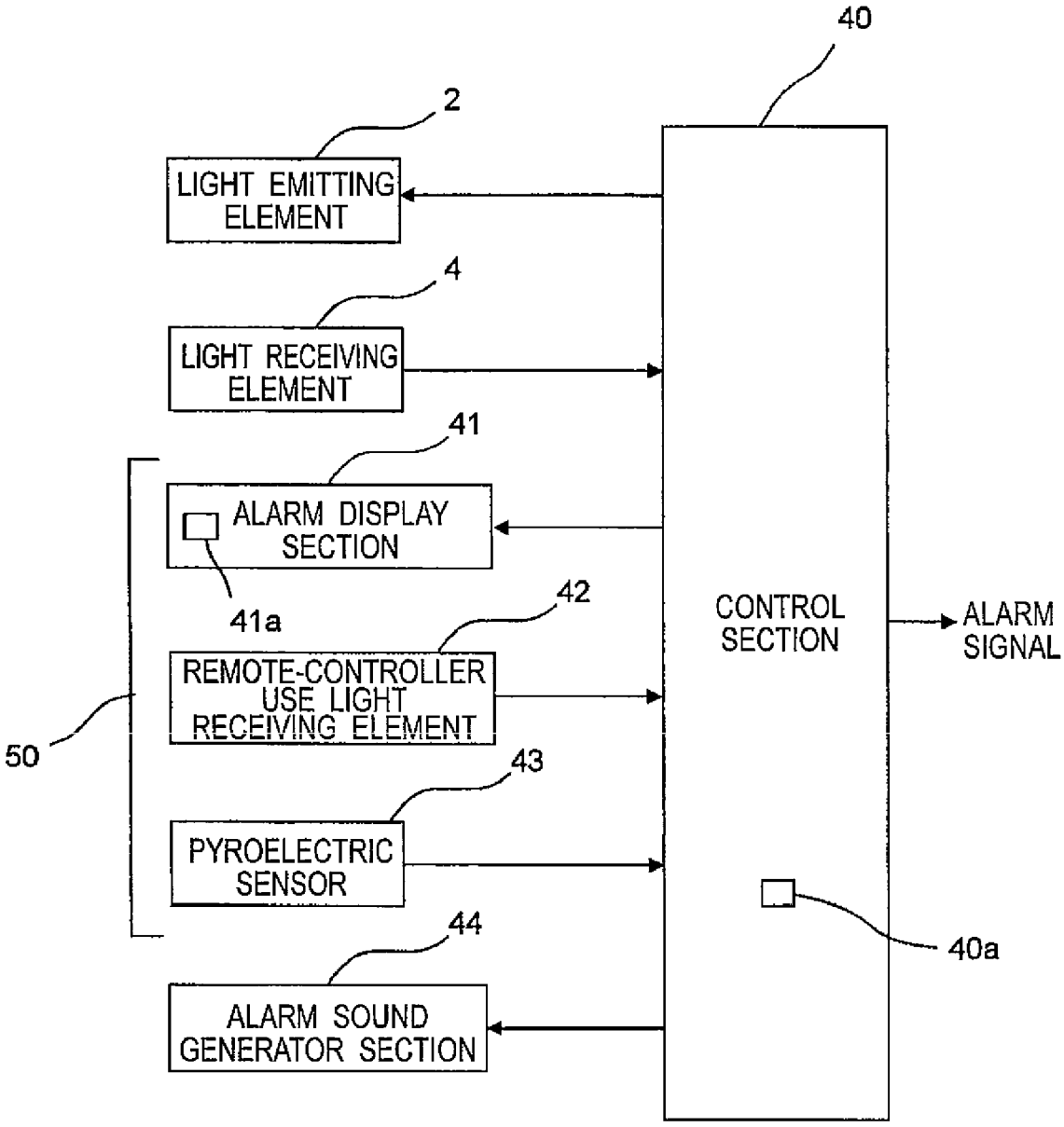
FIG. 11 is a block diagram of a photoelectric smoke sensor which includes a remote-controller use light receiving element, a pyroelectric sensor and an alarm sound generator section according to a fourth embodiment of this invention.

FIG. 11 shows a block diagram of a photoelectric smoke sensor which includes a remote-controller use light receiving element, a pyroelectric sensor and an alarm sound generator section according to a fourth embodiment of the invention. This photoelectric smoke sensor of the fourth embodiment is similar in construction to the photoelectric smoke sensor of the third embodiment shown in FIG. 10, except the alarm sound generator section 44, and so like component members are designated by like reference numerals and their description is omitted.

This photoelectric smoke sensor of the fourth embodiment includes an alarm sound generator section 44 that issues an alarm sound upon sensing of smoke by the smoke sensing portion 40*a*, as shown in FIG. 11.

The photoelectric smoke sensor of this fourth embodiment has effects similar to those of the photoelectric smoke sensor of the third embodiment.

Also, the presence or absence of an indoor human body can be detected by the pyroelectric sensor 43 placed within the window portion 50 of the alarm display section 41, and notification of the presence or absence of any person can be made to the outside by changing the alarm sound level of the alarm sound generator section 44 by the control section 40 depending on the presence or absence of a human body.

Fifth Embodiment

Figure 12:
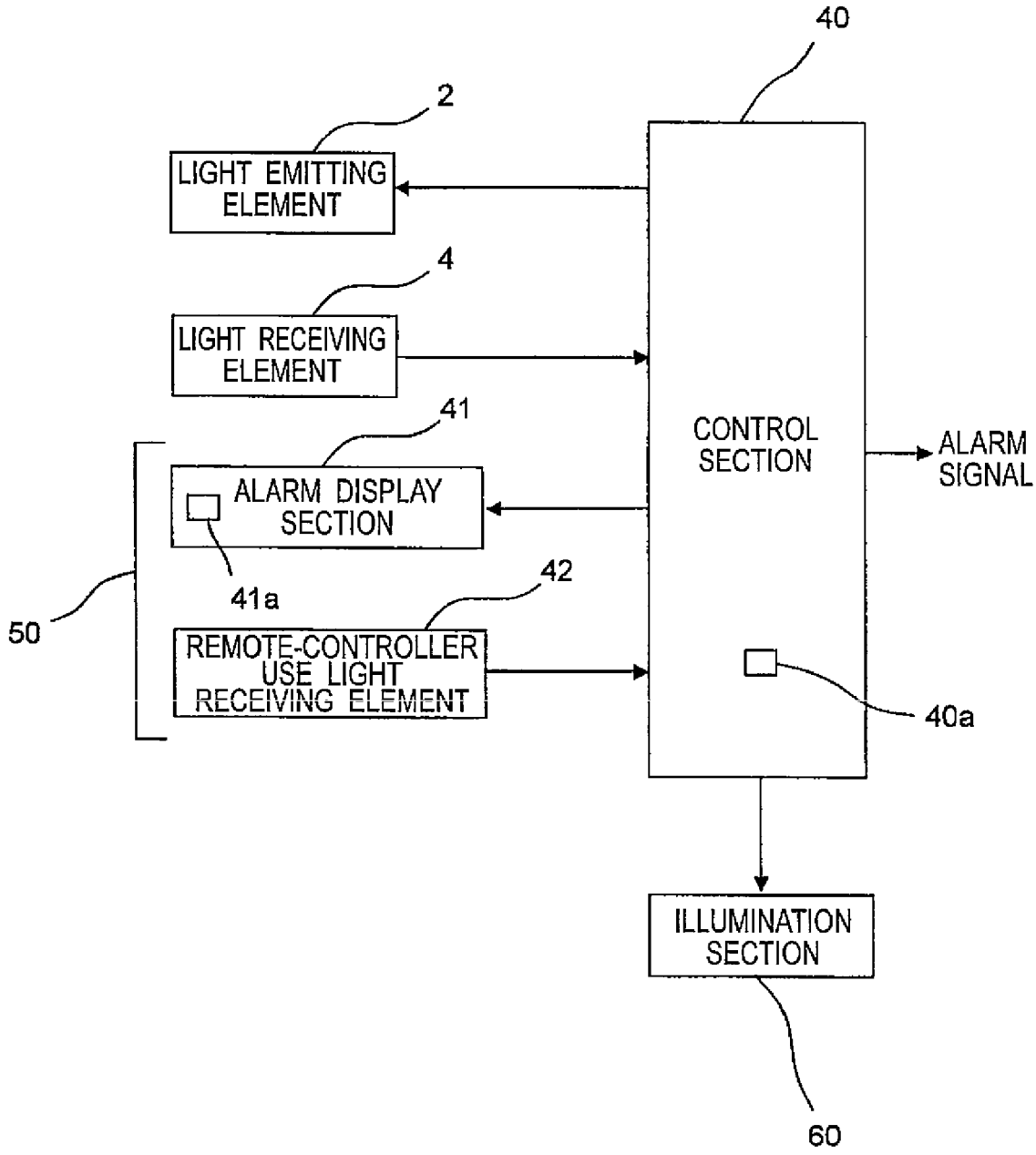
FIG. 12 is a block diagram of lighting equipment according to a fifth embodiment of this invention using the photoelectric smoke sensor.

FIG. 12 shows a block diagram of lighting equipment using the photoelectric smoke sensor according to a fifth embodiment of the invention. This photoelectric smoke sensor of the fifth embodiment is similar in construction to the photoelectric smoke sensor of the second embodiment shown in FIG. 8, except the illumination section 60, and so like component members are designated by like reference numerals and their description is omitted.

This lighting equipment using the photoelectric smoke sensor in the fifth embodiment, as shown in FIG. 12, includes an illumination section 60 which is controlled by the control section 40. The illumination section 60 may be given by any kind of luminaire such as fluorescent lamps and incandescent lamps.

The photoelectric smoke sensor to be used in the lighting equipment of the fifth embodiment, although usable as a smoke sensor alone, yet when contained in the lighting equipment as shown in FIG. 12, is kept from impairing the indoor visual impressions or from the need for boring holes in the ceiling for its mounting. Further, when the remote controller for use of the lighting equipment control or the like is used also for the photoelectric smoke sensor, it becomes unnecessary to prepare another remote controller for the photoelectric smoke sensor only.

According to the photoelectric smoke sensors of the first to fifth embodiments as described above, the optical system can be downsized by such placement of the light emitting element and the light receiving element that the optical axis of the light emitting element and the light-reception axis of the light receiving element cross each other at a point nearby the opening (or within the opening) in the internal space of the casing member and on one plane that is roughly parallel to the opening plane of the opening. Influences of stray light that might increase due to this downsizing can be reduced by providing protrusions inside the casing member or recesses having a light trap effect. As a consequence of these and others, there can be provided a small-sized photoelectric smoke sensor capable of detecting smoke with high precision.

Also according to the photoelectric smoke sensor of the invention, the window portion in the alarm display section is made of a material that transmits not only visible rays but also near- and far-infrared rays. As a result of this, only one window portion, by virtue of its being made of a material that transmits all the wavelengths, will do instead of a plurality of window portions which would conventionally be required as a window portion for the visible light emitting element, as a window portion for the remote-controller use light receiving element using near infrared rays, and as a window portion for the pyroelectric sensor for sensing a human body by far infrared rays, respectively. These individual functions, which differ in wavelength regions in use from one another, can be fulfilled without causing any interferences thereamong even if the window portions are integrated into one portion.

Also according to the photoelectric smoke sensor of the invention, by changing output signal from the microcomputer upon detection of smoke to the alarm display section upon detection of smoke so as to increase the current If of the light emitting section using the LED of the alarm display section, the emitting light quantity can be increased. As a result of this, the brightness of the LED of the alarm display section is changed among the battery level detection mode, the self-diagnosis function operation mode, and the operation checking mode. Thus, current consumption by the LED of the alarm display section in normal use is suppressed, allowing the battery life to be prolonged. Besides, even in rooms filled with smoke, the LED of the alarm display section, by being maximized in its brightness, can show a position of the photoelectric smoke sensor and serve as an emergency lamp by illuminating the surroundings.

Photoelectric smoke sensors, which are often set on the ceiling or at high positions in the wall, have difficulties in actuating the operation checking function or stopping missensing of smoke by switch. However, according to the photoelectric smoke sensor of the invention, the photoelectric smoke sensor becomes safely and easily operable with the use of an infrared remote controller as the remote controller for operation. For this purpose, the part at which the alarm display section lights up is made of a material that transmits infrared rays as well and moreover the remote-controller use light receiving element is included inside the photoelectric smoke sensor, thereby making it possible to achieve a smaller-size, lower-price photoelectric smoke sensor having the function that one window portion displays the alarm and receives the remote-controller use infrared rays.

Also according to the photoelectric smoke sensor of the invention, by the pyroelectric sensor included inside the window portion where the alarm display lights up, the presence or absence of a human body in a room or a passage at which the photoelectric smoke sensor is set can be detected, and notification of that can be made to the outside by changing the alarm sound depending on the presence or absence of any human body. The LED of the alarm display section, the remote-controller use light receiving element and the pyroelectric sensor, which differ in wavelength region in use from one another, do not interfere with one another and so can be used effectively.

Further, when the photoelectric smoke sensor of the invention is mounted on indoor lighting equipment, deteriorations in visual impressions which would be involved in such placement of the photoelectric smoke sensor as on the ceiling or on the wall can be avoided. Besides, an increase in the number of remote controllers can also be avoided by operating the photoelectric smoke sensor with the use of a remote controller which is usually attached to every unit of lighting equipment.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A photoelectric smoke sensor for detecting smoke in a region, as well as its vicinities, where an optical axis of a light emitting element and a light-reception axis of a light receiving element cross each other, the photoelectric smoke sensor comprising:

a casing member in which an internal space is formed by a labyrinth wall and in which an opening communicating with the internal space is provided on a setting-face side; and a printed board which is placed on the setting-face side having the opening of the casing member provided thereon and which has a hole opposed to the opening of the casing member, wherein the light emitting element and the light receiving element are mounted on the printed board in such a fashion that the optical axis of the light emitting element and the light-reception axis of the light receiving element cross each other at a point nearby the opening or within the opening in the internal space of the casing member and on one plane that is substantially parallel to an opening plane of the opening.

2. The photoelectric smoke sensor as claimed in claim 1, wherein a sloped surface forming an obtuse angle to the plane of the opening containing the optical axis of the light emitting element and the light-reception axis of the light receiving element is provided forward of the light emitting element in its optical axis direction and on an inner wall of the opening of the casing member.

3. The photoelectric smoke sensor as claimed in claim 1, wherein triangular-edged projections and depressions each having a fore end projecting inward of the opening of the casing member are provided forward of the light emitting element in its optical axis direction and on an inner wall of the opening of the casing member.

4. The photoelectric smoke sensor as claimed in claim 1, wherein a plurality of protrusions are provided at inner portions of the casing member facing its internal space.

5. The photoelectric smoke sensor as claimed in claim 4, wherein the plurality of protrusions are pyramidal- or conical-shaped.

6. The photoelectric smoke sensor as claimed in claim 1, wherein at least part of the light emitting element is placed in a light emitting element-accommodating recess portion provided in the casing member, and triangular-shaped recesses whose width gradually narrows toward a forward direction are provided on a front-face side of the light emitting element near the light emitting element-accommodating recess portion of the casing member and on both sides of the optical axis of the light emitting element.

7. The photoelectric smoke sensor as claimed in claim 1, further comprising:

a smoke sensing portion for sensing smoke based on a received light quantity detected by the light receiving element; and an alarm display section which has an alarm-display window portion that transmits visible rays and near- and far-infrared rays, and which displays an alarm upon sensing of smoke by the smoke sensing portion.

8. The photoelectric smoke sensor as claimed in claim 7, wherein the alarm display section has an alarm-display light emitting element which is placed within the window portion and which is switchable in at least two steps of light emission intensity.

9. The photoelectric smoke sensor as claimed in claim 7, further comprising a remote-controller use light receiving element provided in the window portion of the alarm display section.

10. The photoelectric smoke sensor as claimed in claim 1, further comprising:

a smoke sensing portion for sensing smoke based on a received light quantity of the light receiving element;

an alarm sound generator section for generating an alarm sound upon sensing of smoke by the smoke sensing portion; and a pyroelectric sensor placed in the window portion of the alarm display section to perform sensing of a human body, wherein the alarm sound generator section is enabled to change a level of the alarm sound based on the presence or absence of a human body sensed by the pyroelectric sensor.

11. Lighting equipment which includes the photoelectric smoke sensor as defined in claim 1.

* * * * *